United States Patent [19]

Saviski et al.

[11] 4,157,815

[45] Jun. 12, 1979

[54] FURNACE BOTTOM CONSTRUCTION WITH SEAL

[75] Inventors: Frederic E. Saviski, Homewood, Ill.; William E. Slagley, Crown Point; Peter K. Strangway, Munster, both of Ind.

[73] Assignee: Inland Steel Company, Chicago, Ill.

[21] Appl. No.: 901,079

[22] Filed: Apr. 28, 1978

[51] Int. Cl.[2] ..... C21B 7/10

[52] U.S. Cl. ..... 266/193; 266/197; 266/280

[58] Field of Search ..... 266/241, 190, 193, 197, 266/198, 280, 283, 286

[56] References Cited

U.S. PATENT DOCUMENTS 3,705,713 12/1972 Wirtz et al. ..... 266/193

*Primary Examiner*—Gerald A. Dost

*Attorney, Agent, or Firm*—Merriam, Marshall & Bicknell

[57] ABSTRACT

A furnace bottom construction comprises refractory blocks resting atop a seal in turn resting on the top surface of a layer of ramming material in which are embedded cooling ducts resting on a concrete foundation. The seal is composed of thin, fluid-impervious, flexible, ductile sheet material deformed to follow the contours and indentations of the top surface of the ramming material. The bottom surface of the seal and the top surface of the ramming material are in intimate contact along substantially the entire area of said top surface, with substantially no air gaps between the two.

12 Claims, 8 Drawing Figures

20
21
22
23
24
25
26
30
31
32
33
34
35
36

21
31
32
33
34
40
41
42
43
44
45
46
47
50
52
53

FURNACE BOTTOM CONSTRUCTION WITH SEAL

BACKGROUND OF THE INVENTION

The present invention relates generally to the bottom construction of industrial processing furnaces, such as metallurgical blast furnaces, and more particularly to a water cooled furnace bottom construction having a fluid-impervious seal for preventing internal gases and liquids from escaping outside and for preventing external gases and liquids from entering the inside of the furnace.

The blast furnace is a large, shaft-like, metallurgical reactor having an outer steel shell lined with refractory material. In the blast furnace, iron-bearing ores are chemically reduced to form pig iron. Impurities in the ores form slag with flux added to the furnace. Hot air, at an elevated temperature and pressure, is blown into the side of the furnace near its base to form reducing gases and to provide heat which melts the iron and slag. The reducing gases, because of the pressure differential up the shaft of the furnace, tend to mainly rise through the furnace and simultaneously heat and reduce the iron-bearing materials which are added from the top.

The hot metal and slag are retained in the refractory-lined lower section of the furnace (the hearth) until they are removed during a "tap" of the furnace. Over a period of time, the molten metal and slag accumulating in the hearth tend to react with and erode the refractory hearth lining, and, as a result, there is a decrease in the lining thickness at the bottom of the furnace interior, both around the side walls and above the hearth base.

Until recently, prior art furnaces had relatively small hearth diameters, and the hearth refractories could be sufficiently cooled by placing water cooled elements, called staves, around the periphery of the furnace hearth, i.e., between the steel plate and the refractory lining. The refractory lining was permitted to erode during furnace operation, and the hearth refractories had to be completely replaced one or two campaigns (a campaign comprises a period of furnace operation for several years). Because there was no cooling of the furnace bottom, i.e., no "under-hearth cooling," the ultimate vertical erosion of the hearth refractory, at the center of the hearth, was normally quite severe, and care had to be taken to ensure that the refractory hearth was relined before the molten metal eroded completely through the hearth refractory at the furnace bottom. Such erosion could cause tremendous physical damage and create a serious safety hazard.

In recent years, the hearth diameter of blast furnaces has increased, and ceramic refractories, previously used to line the hearth, have been replaced to a large extent with carbon refractories. As the hearth diameter increases, it becomes more difficult to withdraw heat from the hearth through the side walls and, as a result, erosion at the center of the hearth into the furnace bottom becomes more significant. In order to decrease this erosion, the underhearth in most large furnaces is cooled in some manner. For example, located below the refractory blocks which compose the hearth are cooling ducts through which a cooling liquid, such as water, is circulated. These cooling ducts rest on a concrete base and are embedded in a material called "ramming mix" which is rammed into place around and over the cooling ducts after the latter have been emplaced. The refractory blocks rest on the ramming mix, usually with a layer of leveling tiles between the blocks and the ramming mix.

It has been common practice to place a fluid-impervious seal, composed of welded steel plate, under the carbon refractories and above the cooling pipes or ducts. Normally, the steel plate is about ½ inch thick, and the seal is very rigid once it is in place. Also, it was common practice to install the ramming mix around the cooling pipes or ducts and between the concrete base and steel plate before the steel plate was emplaced. In the process of welding the component parts of the steel plate in place, the steel warped, causing air gaps between the steel plate and the underlying ramming mix. Each such air gap acts as an insulating layer; and this significantly decreases the overall thermal conductivity in the underhearth and, hence, decreases the flow of thermal energy downwardly from the carbon blocks in the hearth base ultimately into the cooling ducts in the furnace bottom. This, in turn, increases the erosion of the carbon blocks.

Carbon has a higher thermal conductivity than ceramic refractory material and will erode to a lesser depth than ceramic material, for a given set of cooling conditions. It is important that the cooling effect of the cooling ducts in the furnace bottom be manifest to as high a level as possible when carbon blocks are used for the hearth base. As noted above, air gaps between the seal plate and the ramming mix retard this cooling effect, lower the level of the cooling effect and increase the depth to which the carbon blocks will erode.

For example, in a blast furnace having a 45-foot diameter hearth with 116 vertical inches of carbon blocks in the hearth base and no air gaps, the carbon blocks of the hearth were calculated to erode away at the hearth center to a depth of only 38 inches. However, if a ⅛-inch air gap is formed below the entire steel plate and above the ramming mix, the carbon blocks at the center can be expected to erode to a depth of up to 73 inches, so that an additional 25 to 35 inches of carbon refractory material would be lost compared to a furnace bottom with no air gaps. Other calculations with deeper air gaps have shown that additional inches of carbon would be lost.

If a hearth base erodes too deeply during a campaign, it must be replaced when the furnace is shut down for a relining job at the end of a campaign. Replacement of the hearth base is costly in that the carbon blocks are composed of relatively expensive, high quality carbon and the down time for the furnace is increased. Accordingly, it is important that the carbon refractory hearth be usable for many furnace campaigns with a minimum amount of erosion in order to save costs and increase furnace operating time.

SUMMARY OF THE INVENTION

The present invention minimizes the formation of air gaps in the furnace bottom and maintains maximum thermal conductivity between the uppermost carbon blocks in the hearth center and the cooling ducts in the furnace bottom or underhearth. In accordance with the present invention, the rigid, steel seal plate is replaced with a thin sheet of relatively flexible, ductile material, such as copper. The flexible sheet is laid on top of the ramming mix and gently tapped, pressed or rolled to deform the sheet slightly and cause it to follow the contours and indentations of the top surface of the ramming mix. This provides intimate contact between the bottom surface of the sheet and the top surface of the ramming mix along substantially the entire area of said top surface, and such intimate contact eliminates or minimizes any possible air gaps beneath the sheet.

A layer of mortar is then placed on top of the flexible sheet to fill any depressions in the sheet where the latter deformed into indentations in the ramming mix, and then the normal leveling tiles and bricks and the carbon hearth blocks are installed above the sheet. Because of the flexibility and ductility of the sheet, any additional compacting of the ramming mix due to the weight of the overlying carbon blocks, etc., will result in additional slight deformation of the flexible sheet to prevent the formation of insulating air gaps beneath the sheet during both the installation of the carbon blocks and subsequent operation of the furnace.

The flexible sheet is fluid-impervious and thus provides the necessary seal for the furnace bottom. The sheet will prevent furnace gases that penetrate downwardly through the carbon refractory blocks from escaping outside at the bottom of the furnace, and it will also prevent water or air from the atmosphere or a leaking cooling duct from entering upwardly into the furnace.

As noted above, the thin, flexible sheet rests on the ramming mix in intimate contact with the latter. The two cooperate to transmit pressure forces from above to the underlying furnace bottom foundation composed of concrete or of a steel base plate placed on top of the concrete. Hence, because of the overall construction of the furnace bottom, the thin, flexible sheet also performs a structural function and acts as a true bottom seal plate. This is so even though the sheet would not have sufficient structural strength by itself to support the full furnace interior forces if the sheet were not in intimate contact with the underlying layers of the furnace bottom.

The seal is normally formed from sheets or strips joined and sealed to each other along adjacent edges by soldering or brazing or by using an adhesive material that is impermeable to the gases and will withstand the temperatures encountered in furnace operation.

At the junction, between the flexible, ductile seal and the steel furnace shell, the seal can be bent upwards adjacent the shell so that the steel shell and the seal overlap for 1 to 3 inches, and then the gap between the sheet and the steel shell can be sealed with an appropriate adhesive or by brazing or soldering.

Other features and advantages are inherent in the structure claimed and disclosed or will become apparent to those skilled in the art from the following detailed description in conjunction with the accompanying diagrammatic drawings.

DETAILED DESCRIPTION

Figures 1, 2, 4:
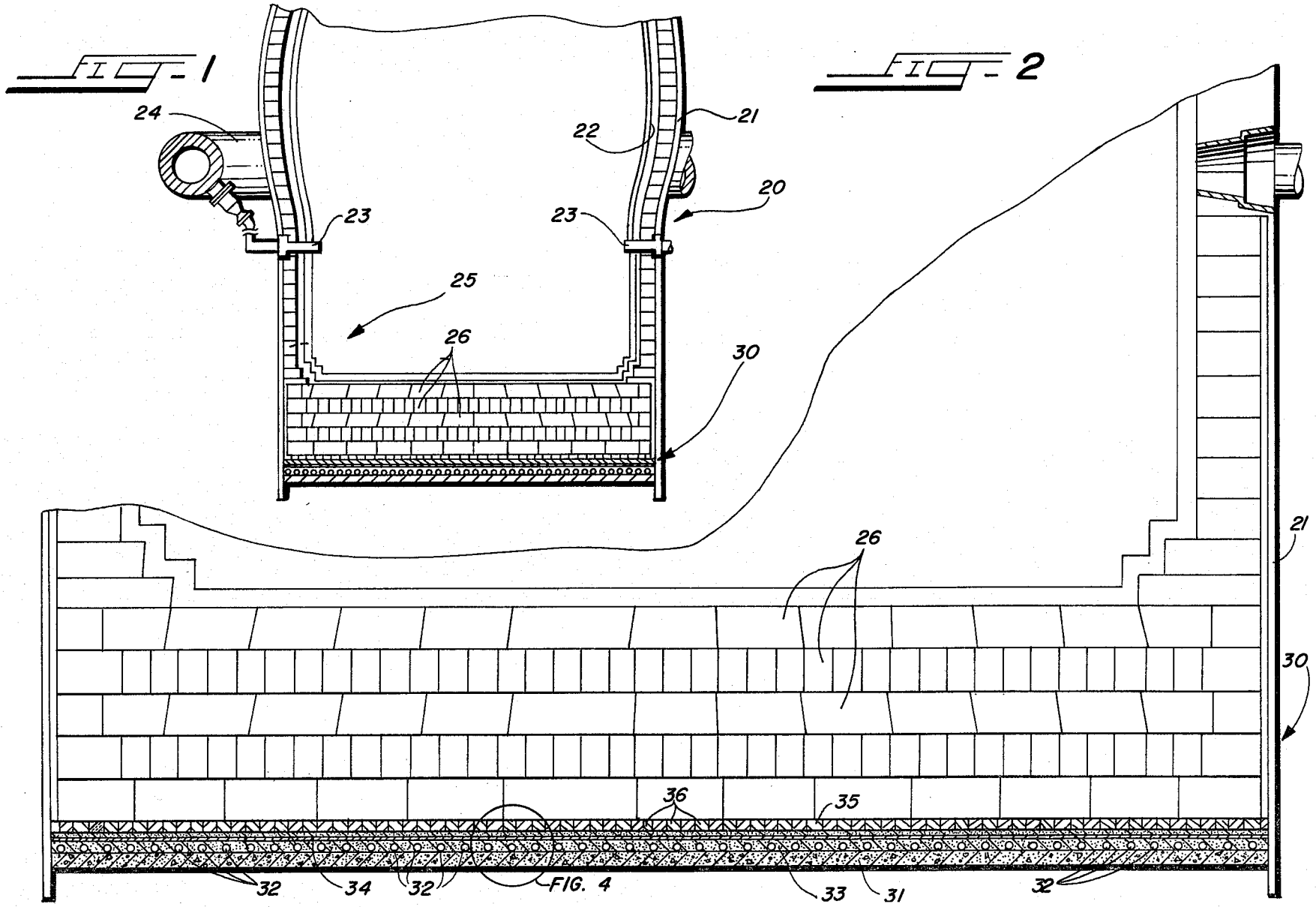
FIG. 1 is a fragmentary, vertical sectional view of a metallurgical blast furnace having a bottom construction in accordance with an embodiment of the present invention.
FIG. 2 is an enlarged, fragmentary view of the furnace bottom construction.
FIG. 4 is a view, similar to FIG. 3, of the same portion of the furnace bottom as shown in FIG. 3, but enlarged still further.

Referring initially to FIG. 1, indicated generally at 20 is a blast furnace comprising a steel side shell 21 lined with refractory material 22 and having a plurality of tuyeres 23, 23 connected to a tuyere manifold or bustle 24. Blast furnace 20 includes a hearth 25 comprising a plurality of carbon blocks 26 arranged in layers and located above a furnace bottom indicated generally at 30.

Figure 3:
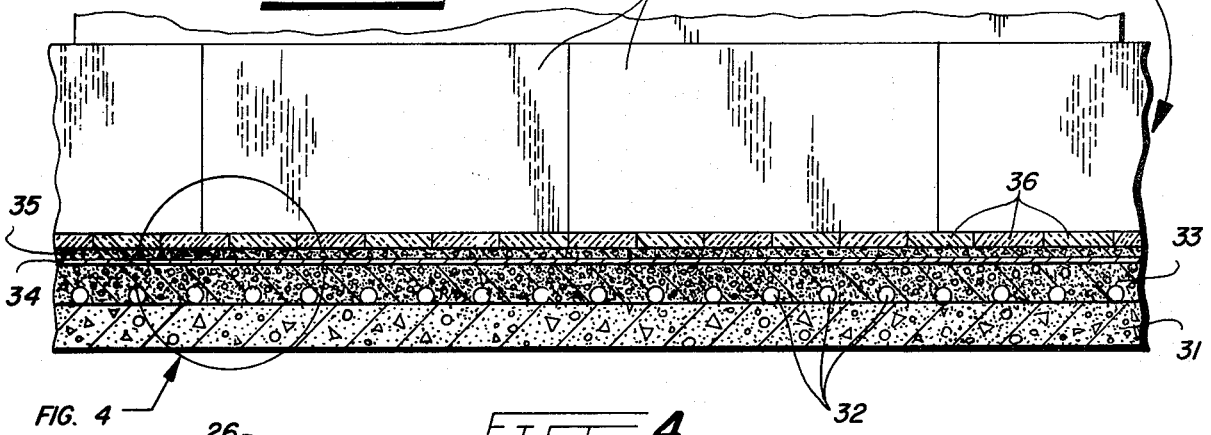
FIG. 3 is an enlarged, sectional view of a portion of the furnace bottom construction.
Figure 4:
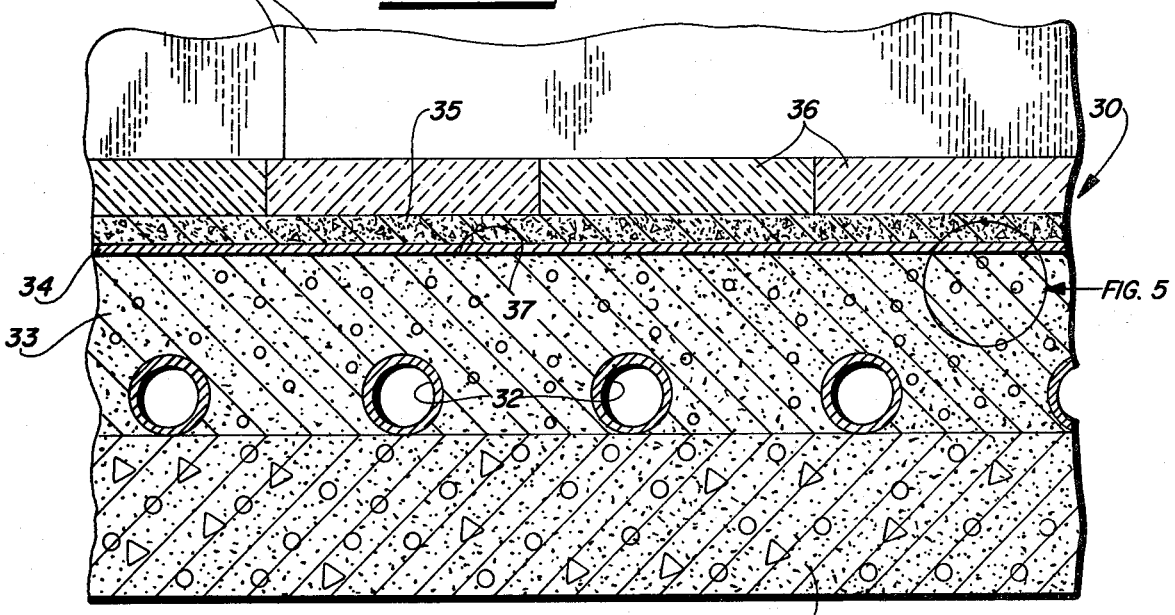

Referring to FIGS. 2–4, furnace bottom 30 comprises a concrete foundation 31 (e.g., composed of alumina concrete) and a plurality of cooling ducts or tubes 32 resting atop concrete foundation 31. Cooling ducts 32 are embedded in a layer of ramming material or mix 33 atop which rests a seal 34 composed of flexible sheet material and deformed to follow the contours and indentations of the top surface 37 of ramming mix 33.

Figure 5:
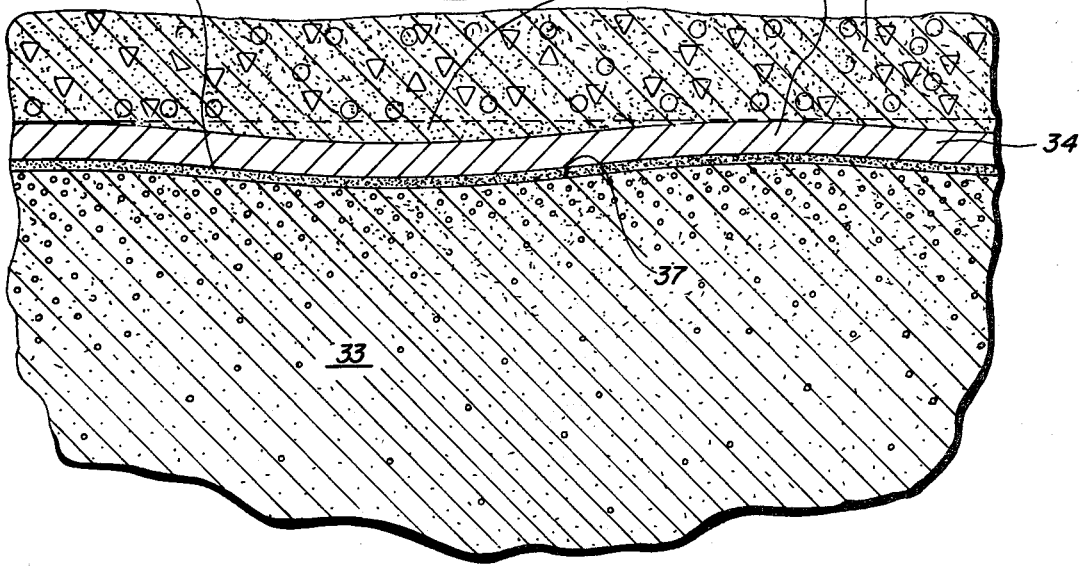
FIG. 5 is a view, enlarged still further, of a portion of the furnace bottom construction illustrated in FIG. 4.

The deformation of seal 34 is illustrated more fully in FIG. 5. Seal 34 is adhered to the top surface 37 of ramming mix 33 with adhesive 38.

Located atop seal 34 is a layer of mortar 35 (FIGS. 3–4) which fills in any depressions 39 in seal 34 (FIG. 5) resulting from the above-described deformation of the seal. Resting on mortar layer 35 are a plurality of leveling tiles or paviors 36.

As previously noted, seal 34 is composed of thin sheet material, flexible enough and ductile enough to permit deformation thereof to follow the contours and indentations of the top surface of the ramming material. This substantially eliminates air gaps between top surface 37 of ramming material 33 and the bottom surface of seal 34. Elimination of the air gaps improves the transfer of thermal energy from carbon blocks 26 in hearth 25 to cooling ducts 32. As a result, there is less erosion of carbon blocks 26, and hearth 25 will last longer.

The indentations or contours in top surface 37 (FIG. 5) may have a depth of only 1/16–⅛ inch, for example, because top surface 37 is generally flat. But even an indentation or contour depth that small can create an undesirable air gap between seal 34 and top surface 37, unless seal 34 is deformed the slight amount necessary to follow the contours and indentations of the top surface of the ramming material.

In addition to the advantages noted above, the flexible sheet material of seal 34 and the layer of ramming material 33 cooperate to transmit pressure forces from above seal 34 through the seal and the layer of ramming material without causing the seal to fail and without creating an air gap below the seal, either during construction or operation of furnace 20.

Figures 6, 7, 8:
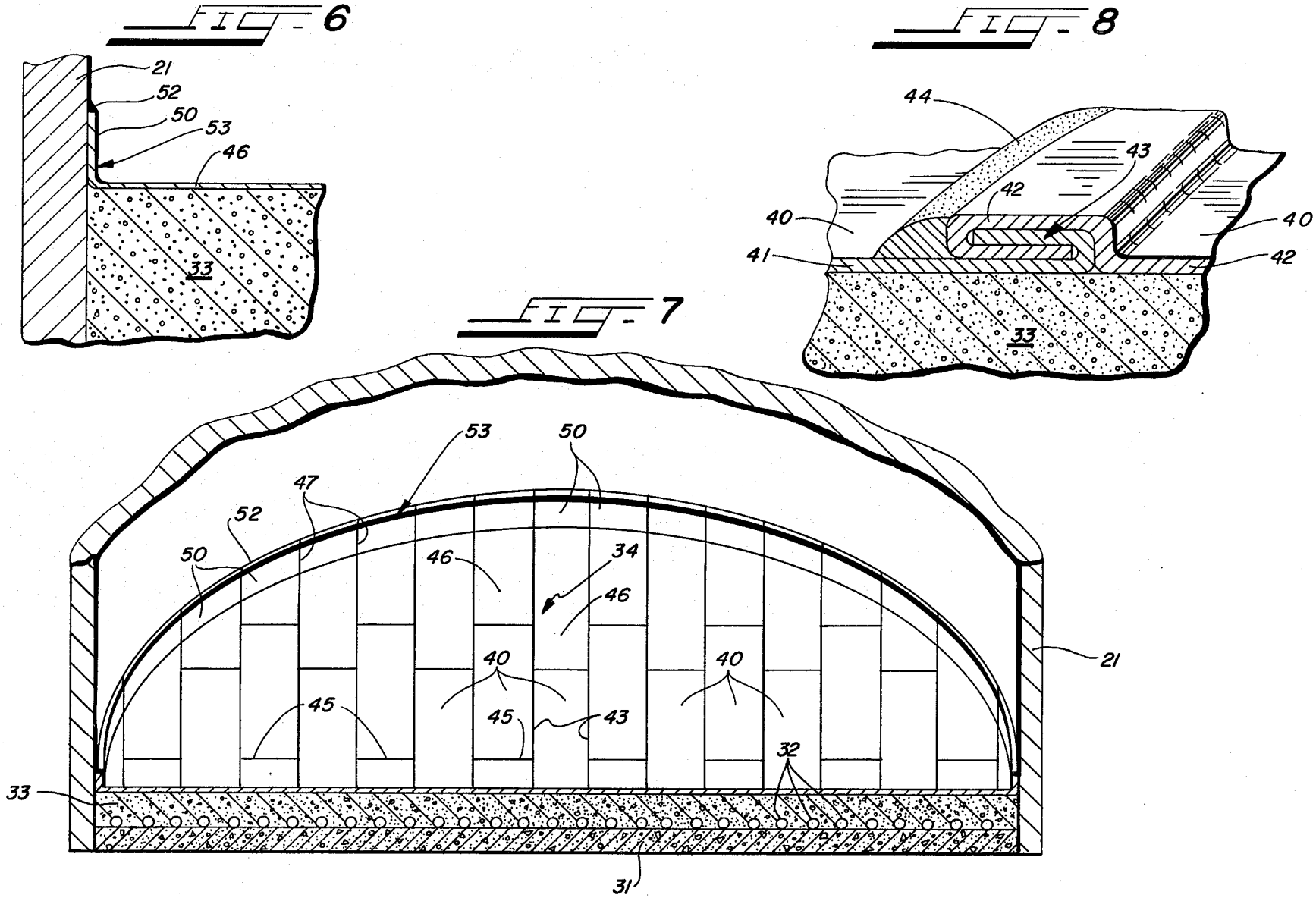
FIG. 6 is a fragmentary, sectional view of that portion of the bottom construction where the seal joins the steel side shell of the furnace.
FIG. 7 is a fragmentary perspective illustrating the furnace bottom construction.
FIG. 8 is a perspective illustrating the manner in which strips of material are joined together to form the bottom seal.

In a preferred embodiment, seal 34 is composed of a plurality of thin copper strips joined together to provide one continuous, uninterrupted seal covering the entire area at the bottom of the furnace, and this embodiment is illustrated in FIGS. 6–8.

More particularly, seal 34 is composed of a plurality of adjacent copper strips 40, 40 each having a pair of opposite edge portions 41, 42 joined to an adjacent edge portion of an adjacent strip 40 with a mechanical lock joint 43 illustrated in FIG. 8. Joint 43 is formed from adjacent edge portions of adjoining strips 40, 40, along the entire length of the adjacent edge portions, to hold an adjacent pair of strips together. After mechanical lock joint 43 is formed, the joint is sealed with metallic sealing means, such as solder 44 (or brazing material) extending the entire length of lock joint 43. The metallic sealing means, such as solder 44, is non-reactive with the metallic strips forming seal 34, in a corrosive manner, during operation of the furnace. For example, when strips 40, 40 are composed of copper, metallic sealing means 44 may be composed of silver solder.

The mechanical joint 43 illustrated in FIG. 8 is shown as applied along the longitudinal edges of adjoining strips 40, 40. A similar mechanical lock joint 45 (FIG. 7), sealed with a similar metallic seal (e.g., like solder seal 44 in FIG. 8), is formed at the lateral edge portions of adjoining strips 40, 40.

In a typical assembly operation, a plurality of copper strips 40, 40, each about 24 inches wide and 10 feet long, are laid end to end across the furnace bottom and their lateral edges are joined together at 45 and solder sealed to form a row 46 of strips, extending from one wall portion of the furnace to the opposite wall portion. Next, a similar row 46 of strips is assembled alongside the first row 46, and the longitudinal edge portions of the adjacent rows are joined together at 43 and solder sealed. Then, the resulting assemblage of rows is lifted up along opposite longitudinal edges, and adhesive is applied to the top surface 37 of the underlying layer of ramming mix 33 and to the bottom surface of the strips at locations inwardly of the outer longitudinal edges of the assemblage. The assemblage of rows is then replaced on top surface 37, and the component strips 40, 40 are deformed, e.g., with a roller or padded board, to follow the contours and indentations of top surface 37 (see FIG. 5). The operation is then repeated with additional rows 46, preferably working from the center to the outside of the furnace bottom.

The adhesive for securing the strips 40 to the top surface 37 of the ramming mix should be of a composition which is non-reactive with the metallic sheet material of which the seal 34 is composed. In other words, when seal 34 is composed of copper, the adhesive should be non-reactive with the copper in a corrosive manner during operation of the furnace.

Each composite strip row 46 terminates at an upwardly extending portion 50 secured with adhesive (not shown) to steel side shell 21 (FIG. 6). The upwardly extending portions 50 on each strip row 46 are joined together along their longitudinal edges 47, in the same manner that strips 40 were joined together along their longitudinal edges at joint 43. When thus joined together, the upwardly extending portions 50 form a peripheral portion 53 extending upwardly about 1–3 inches alongside the steel side shell 21, around the entire periphery of the side shell, and terminating at a top edge 52. This peripheral portion may be sealed to steel side shell 21 continuously along the entire length of peripheral portion 53 with adhesive sealing means (not shown) applied between steel side shell 21 and peripheral seal portion 53.

As previously noted, copper sheet is the preferred material for the flexible seal. However, any thin, metal sheet such as aluminum, aluminum alloys, titanium, brass, bronze, copper-nickel alloys or other copper base alloys, carbon steel, galvanized steel, alloy steel, stainless steel, etc., could be used, provided that the material and thickness selected provides a sheet having sufficient flexibility and ductility to deform enough to eliminate any potential air gaps between the sheet and ramming mix during both installation of the seal and ultimate furnace operation. A suitable high temperature plastic material could also be used, provided it has the desired properties described herein.

In addition, the thin, metal sheet should be thick enough to resist tearing during installation and should be able to withstand corrosion from both the furnace gases above and the moisture and gases beneath the sheet during the desired life of the furnace hearth refractory.

For example, when copper is used for the seal, a 0.005 inch thick sheet may be used. However, the thickness could range from 0.002 inch to 0.100 inch. With a 0.005 inch sheet, all requirements are readily met. The flexibility and ductility are sufficient to ensure that substantially all air gaps will be eliminated, while the thickness is sufficient to avoid tearing or mechanical failure of the sheet during installation. For other metallic sheet materials, the thickness selection should be within the skill of the art given the desired characteristics for the sheet material described above.

Whatever the sheet material, it and the bonding agent (solder, adhesive, etc.) must not react with each other in a corrosive manner during furnace operation. Also, the sheet material for the seal should be of a composition, such as copper, which does not oxidize in preference to the steel shell plate to avoid corrosion of the sheet material. Also, any adhesives used must be capable of withstanding the temperatures and corrosive environments to which they would be exposed.

In one example of a furnace bottom construction with seal, in accordance with the present invention, the seal 34 is assembled from strips of soft, oxygen free, high conductivity copper, 0.005 inches thick and 24 inches wide. The strips 40, 40 are each 10 feet long and sealed to each other along lateral and longitudinal edges with a rod-type, flux-coated silver alloy brazing material composed 57–61% silver, 20–23% copper, 16–18% zinc and 4–6% tin. The flux coating on the rod and any supplemental flux is a grain-type composed of 20% potassium fluoridate, 50% boron oxide and 10% potassium borate. The adhesive used for securing seal 34 to top surface 37 of ramming mix 33 is a non-flammable, synthetic based elastomer commercially available under the name "Scotch-Grip #35" from 3M Company.

The adhesive used to secure the upwardly extending peripheral seal portions 50 to steel side shell 21 is a room temperature vulcanizing silicone elastomer sealant commercially available under the name RTVR #732 from Dow Corning Corporation. This adhesive sealant is acetic acid cured and has a cured durometer hardness of 25 with a service temperature range of −65° F. to 450° F. The steel side shell is prepared for the adhesive sealant with a primer which may be a silicone hydrocarbon polymer fluid comprising an air drying, dilute solution of moisture reactive materials, silane and varnish makers' and painters' naptha, said fluid being commercially available under the name Dow Corning #1200 from Dow Corning Corporation.

If the seal is composed of steel, the strips of steel may be assembled into a seal with adhesive and may be attached to the steel side shell also with adhesive. When the seal is composed of aluminum (or of copper) the strips of this material may be assembled into a seal by glueing with a high temperature glue or by soldering with a low temperature paste solder applied with a heated iron. Metal materials other than steel may be attached and sealed to the steel side shell with a high temperature rubber sealant, as described above in connection with the copper seal material. When the seal is composed of plastic material, the strips of this material may be assembled together and attached to the steel side shell with high-temperature adhesives.

The seal may also be formed by providing a thin layer or layers of metal (e.g., aluminum) applied by flame spraying on top surface 37 of the ramming material, in which case no adhesives are needed.

Gas leakage between the steel side shell and the upwardly extending peripheral seal portions, can be avoided by providing the silicone rubber adhesive sealant between the two as a continuous layer covering the entire surface area between the two different metals.

The layer of ramming material 33 may be a high thermal conductivity, electrode graphite-based material having a tar-based binder and is commercially available under the name Carblox HCB.

The layer of mortar 35 atop seal 34 may be a high thermal conductivity, bedding mortar based on a mixture of tabular alumina and silicon carbide.

The alumina concrete base 31 may be a mixture of one part lumnite cement and three parts crushed firebrick. The lumnite cement is a low purity, calcium aluminate material composed of 44% calcium aluminate, 8.5% iron, 35.8% calcium oxide, 8.6% silicon dioxide, 0.7% magnesium oxide and 1.7% sulfur trioxide. The crushed firebrick is composed of particles ranging from dust size to 1 inch and has approximately 40% alumina, 53% silica, 1.8% alkalies and 5.2% miscellaneous oxides.

The leveling tiles 36 may be a carbon based refractory composed of 93% carbon, 2.6% silica, 1.8% alumina, 1.5% $Fe_2O_3$, 0.19% CaO and MgO, and 0.23% $Na_2O$ and $K_2O$.

In summary, the present invention provides a seal plate that is sufficiently flexible and ductile and can be installed in such a manner as to eliminate or minimize air gaps in the underhearth of the blast furnace. This improves the transfer of thermal energy from the carbon blocks of the hearth to the cooling ducts under the hearth. As a result, there is less carbon erosion in the hearth, the carbon hearth will last for a longer period of time, the overall costs of operating the furnace are reduced, the frequencies of replacing the carbon hearth are reduced and the safety of operation is enhanced.

Although the present invention is directly primarily at providing an improved seal at the bottom of a metallurgical blast furnace, the invention can also be used in other pressure vessels, such as other metallurgical furnaces, (e.g., cupolas or aluminum reduction furnaces), chemical reactors, etc.

Moreover, although the present invention is described in relation to large diameter blast furnaces with high conductivity carbon hearths, the invention could also be used on any blast furnace including small diameter ones and those with ceramic, low conductivity carbon or graphite hearths.

The foregoing detailed description has been given for clearness of understanding only, and no unnecessary limitations should be understood therefrom, as modifications will be obvious to those skilled in the art.

What is claimed is:

1. In a furnace bottom:

a bottom hearth layer of refractory material;

a layer of ramming material located below said bottom hearth layer and having a top surface;

cooling means in said layer of ramming material;

seal means, impervious to liquid and gas and located on the top surface of said layer of ramming material, for preventing the escape downwardly below said seal means of gas from the interior of the furnace and to prevent the escape upwardly into said furnace interior of fluid from below said seal means;

said seal means comprising a thin layer of material which follows the contours and indentations of said top surface of the ramming material to substantially eliminate air gaps between said top surface of the ramming material and the bottom surface of said fluid-impervious material;

said bottom surface of said seal means being in intimate contact with said top surface of the ramming material along substantially the entire area of said top surface.

2. In a furnace bottom as recited in claim 1 wherein:

said seal means is composed of ductile, flexible sheet material deformed to follow said contours and indentations.

3. In a furnace bottom as recited in claim 2 wherein:

said sheet material is secured with adhesive to the top surface of said layer of ramming material.

4. In a furnace as recited in claim 3 wherein:

said sheet material is composed of a plurality of adjacent metallic strips;

each adjacent pair of strips having mutually adjacent edge portions;

means at said edge portions, along the entire length thereof, for holding said pair of strips together;

and sealing means for sealing said edge portions along the entire length thereof;

said sealing means being non-reactive with said metallic strips in a corrosive manner during operation of the furnace.

5. In a furnace bottom as recited in claim 2:

a side shell surrounding said furnace bottom and composed of steel;

said sheet material comprising a peripheral portion extending upwardly alongside said steel side shell and terminating at a top edge;

and means for securing said peripheral portion of the sheet material to said steel side shell continuously around said side shell.

6. In a furnace bottom as recited in claim 5:

said sheet material being composed of a material differing from that of said steel side shell;

and said securing means comprises adhesive sealing means extending continuously along the entire length of said peripheral portions for preventing gas leakage between said peripheral portions and said steel side shell during operation of the furnace.

7. In a furnace bottom as recited in claim 2 wherein:

said sheet material is composed of copper.

8. In a furnace bottom as recited in claim 7 wherein:

said copper sheet material has a thickness in the range 0.002–0.1 inch.

9. In a furnace as recited in claim 2 wherein:

said sheet material is composed of metallic material selected from the group consisting of aluminum, aluminum alloys, titanium, brass, bronze, copper-nickel alloys and other copper-base alloys, carbon steel, galvanized steel, alloy steel and stainless steel;

said metallic material being thin enough and ductile enough to deform sufficiently to follow the contours and indentations of said top surface of the ramming material to substantially eliminate said air gaps;

said metallic material being thick enough and strong enough to resist tearing during installation.

10. In a furnace bottom as recited in claim 2 wherein:

said sheet material is secured with adhesive to the top surface of said layer of ramming material;

said sheet material being non-reactive with said adhesive in a corrosive manner during operation of the furnace.

11. In a furnace bottom as recited in claim 2 wherein:

said sheet material and said layer of ramming material comprise means cooperating to transmit pressure forces from about said seal through said seal and said layer of ramming material without causing said sealing means to fail and without creating an air gap below said sealing means.

12. In a furnace bottom as recited in claim 2 wherein said bottom hearth layer is composed of blocks of refractory material and said furnace bottom further comprises:

a layer of mortar atop said sealing means, said mortor comprising means for filling in any depressions in said sheet material resulting from the above-recited deformation of said sheet material;

and a layer of leveling tiles between said layer of mortar and said blocks of refractory material.

* * * * *